US008146310B2

(12) United States Patent
Keene

(10) Patent No.: US 8,146,310 B2
(45) Date of Patent: Apr. 3, 2012

(54) NOISE CONTROL FLOORING SYSTEM

(75) Inventor: James R. Keene, Pepper Pike, OH (US)

(73) Assignee: Keene Building Products Co., Inc., Mayfield Heights, OH (US)

( * ) Notice: Subject to any disclaimer, the term of this patent is extended or adjusted under 35 U.S.C. 154(b) by 295 days.

(21) Appl. No.: 12/401,733

(22) Filed: Mar. 11, 2009

(65) Prior Publication Data

US 2010/0229486 A1 Sep. 16, 2010

(51) Int. Cl.
*E04B 5/00* (2006.01)

(52) U.S. Cl. ..... 52/403.1; 52/408; 52/309.14; 442/36; 442/42; 442/57; 442/394

(58) Field of Classification Search ..... 52/783.1, 52/408, 403.1, 390, 309.9, 309.4, 309.14, 52/309.13; 442/35, 36, 38–41, 42, 57, 394–399
See application file for complete search history.

(56) References Cited

U.S. PATENT DOCUMENTS

| | | | | |
|---|---|---|---|---|
| 2,069,755 | A | 2/1937 | Foster | |
| 2,388,968 | A | 11/1945 | Hedgren | |
| 2,799,232 | A | 7/1957 | Jaeger | |
| 2,897,109 | A | 7/1959 | Voigtman | |
| 3,122,073 | A * | 2/1964 | Masse | 52/515 |
| 3,451,758 | A | 6/1969 | McClain | |
| 3,468,096 | A | 9/1969 | Franz | |
| 3,500,618 | A | 3/1970 | Sokol | |
| 3,501,878 | A | 3/1970 | Segal | |
| 3,596,425 | A | 8/1971 | Kodaras | |
| 3,686,049 | A | 8/1972 | Manner et al. | |
| 3,687,759 | A | 8/1972 | Werner et al. | |
| 3,691,004 | A | 9/1972 | Werner et al. | |
| 3,837,988 | A | 9/1974 | Hennen et al. | |
| 3,847,524 | A | 11/1974 | Mott | |
| 3,900,102 | A | 8/1975 | Hurst | |
| 4,010,748 | A | 3/1977 | Dobritz | |
| 4,012,249 | A | 3/1977 | Strapp | |
| 4,073,997 | A | 2/1978 | Richards et al. | |
| 4,094,380 | A | 6/1978 | Kobayashi et al. | |
| 4,211,807 | A | 7/1980 | Yazawa et al. | |
| 4,212,692 | A | 7/1980 | Rasen et al. | |
| 4,315,392 | A | 2/1982 | Sylvest | |
| 4,546,024 | A | 10/1985 | Brown | |
| 4,617,219 | A | 10/1986 | Schupack | |
| 4,681,786 | A | 7/1987 | Brown | |
| 4,685,259 | A | 8/1987 | Eberhart et al. | |

(Continued)

OTHER PUBLICATIONS

Construction Canada; Sep. 2000 Issue; pp. 14-16; "Controlling the Transmission of Impact Sound Through Floors"; Sep. 2000.

(Continued)

*Primary Examiner* — Robert Canfield
*Assistant Examiner* — Jessie Fonseca
(74) *Attorney, Agent, or Firm* — Renner, Otto, Boisselle & Sklar, LLP

(57) ABSTRACT

A noise control flooring system is presented herein for reducing noise transmission in a building structure that contains the system. The system comprises a solid substrate layer, a compressible layer overlying at least a portion of the substrate layer, and an entangled net layer that overlies at least a portion of the compressible layer, wherein the net layer is comprised of multiple polymer filaments and air, together forming a void space. A separation layer overlies at least a portion of the entangled net layer. The separation layer carries a floating solid substrate layer thereupon. This solid substrate layer provides loading for causing the compressible layer to compress into the overlying entangled net layer.

15 Claims, 1 Drawing Sheet

U.S. PATENT DOCUMENTS 4,698,249 A 10/1987 Brown
4,841,705 A 6/1989 Fuhrer
4,851,277 A 7/1989 Valkenburg et al.
4,879,856 A 11/1989 Jones et al.
4,942,699 A 7/1990 Spinelli
5,031,721 A 7/1991 Barden et al.
5,052,157 A 10/1991 Ducroux et al.
5,099,627 A 3/1992 Coulton et al.
5,111,627 A 5/1992 Brown
5,187,905 A * 2/1993 Pourtau et al. ..... 52/144
5,205,091 A 4/1993 Brown
5,224,315 A 7/1993 Winter, IV
5,230,189 A 7/1993 Sourlis
5,230,192 A 7/1993 Webb et al.
5,259,157 A 11/1993 Ault
5,343,661 A 9/1994 Sourlis
5,369,926 A 12/1994 Borland
5,383,314 A 1/1995 Rothberg
5,489,462 A 2/1996 Sieber
5,572,842 A 11/1996 Stief et al.
5,584,950 A * 12/1996 Gaffigan ..... 156/71
5,589,242 A 12/1996 Stief et al.
5,598,673 A 2/1997 Atkins
5,619,832 A 4/1997 Myrvold
5,641,950 A 6/1997 Kotter
5,652,001 A 7/1997 Perry et al.
5,669,192 A 9/1997 Opdyke et al.
5,673,521 A 10/1997 Coulton et al.
5,730,548 A 3/1998 Brero et al.
5,756,942 A 5/1998 Tanaka et al.
5,867,957 A 2/1999 Holtrop
5,902,432 A 5/1999 Coulton et al.
5,907,932 A 6/1999 LeConte et al.
5,937,594 A 8/1999 Sourlis
5,960,595 A 10/1999 McCorsley, III et al.
5,984,044 A 11/1999 Christensen
6,023,892 A 2/2000 Sourlis
RE36,676 E 5/2000 Sourlis
6,067,781 A 5/2000 Ford et al.
6,112,476 A 9/2000 Schulenburg
6,131,353 A 10/2000 Egan
6,167,668 B1 * 1/2001 Fine et al. ..... 52/403.1
6,171,984 B1 1/2001 Paulson et al.
6,253,872 B1 7/2001 Neumann
6,256,955 B1 7/2001 Lolly et al.
6,277,024 B1 8/2001 Coulton
6,298,613 B1 10/2001 Coulton
6,308,472 B1 10/2001 Coulton
6,355,333 B1 3/2002 Waggoner et al.
6,594,965 B2 7/2003 Coulton
6,662,504 B2 12/2003 Krogstad
6,676,199 B2 1/2004 Buisson et al.
6,759,135 B2 7/2004 Bramlett et al.
6,786,013 B2 9/2004 Coulton
6,804,922 B1 10/2004 Egan
6,817,442 B2 11/2004 Van Sleet et al.
6,883,284 B1 4/2005 Burgunder et al.
6,920,723 B2 7/2005 Downey
6,981,916 B2 1/2006 Coulton
6,983,822 B2 1/2006 O'Regan et al.
6,990,775 B2 1/2006 Koester
7,093,395 B2 8/2006 Hinault et al.
7,096,630 B1 8/2006 Keene et al.
7,182,688 B2 2/2007 Coulton
7,384,331 B2 6/2008 Coulton
7,393,273 B2 7/2008 Ehrman et al.
7,422,520 B2 9/2008 Coulton et al.
7,765,761 B2 8/2010 Paradis
2002/0025751 A1 2/2002 Chen et al.
2002/0170648 A1 11/2002 Dinkel
2003/0033779 A1 * 2/2003 Downey ..... 52/403.1
2003/0114055 A1 6/2003 Burton et al.
2003/0207640 A1 * 11/2003 Anderson et al. ..... 442/394
2004/0129493 A1 7/2004 Campbell
2004/0182037 A1 9/2004 Sourlis
2005/0009428 A1 1/2005 Porter et al.
2005/0103568 A1 5/2005 Sapoval et al.
2005/0144901 A1 7/2005 Egan et al.
2005/0178613 A1 8/2005 Humphries et al.
2005/0194205 A1 9/2005 Guo
2005/0284059 A1 12/2005 Rerup
2005/0284690 A1 12/2005 Proscia et al.
2006/0117687 A1 6/2006 Ehrman et al.
2006/0144012 A1 * 7/2006 Manning et al. ..... 52/782.1
2006/0230699 A1 * 10/2006 Keene ..... 52/480
2007/0000198 A1 1/2007 Payne et al.
2007/0051069 A1 3/2007 Grimes
2007/0234650 A1 10/2007 Coulton et al.
2007/0261365 A1 11/2007 Keene
2007/0289238 A1 12/2007 Payne et al.
2008/0041005 A1 2/2008 Ehrman et al.
2008/0148669 A1 6/2008 Ehrman et al.
2008/0220714 A1 9/2008 Caruso et al.
2008/0289292 A1 11/2008 Giles et al.
2009/0025316 A1 1/2009 Coulton et al.
2009/0038249 A1 2/2009 Coulton et al.
2009/0241453 A1 10/2009 Dellinger et al.
2009/0242325 A1 10/2009 Dellinger et al.

OTHER PUBLICATIONS

Dow Chemical Company, Midland, MI 48674; five pages of information on "Styrofoam Weathermate Plus"; believed to be published 2003.

Colbond, Inc., Enka, NC 28728; four pages of information on Enka-Engineered "Enkasonic Sound Control Matting"; Jul. 2001.

Liner Rolpanit Incorporated North America, Toronto M6G3H1, four pages, entitled "Introducing a Unique Solution to Pitch Roof Vapor Control"; believed to be published 2003.

Keene Building Products, Website, Jan. 8, 2009, pp. 1-16, Quiet Qurl® Noise Control Products.

* cited by examiner

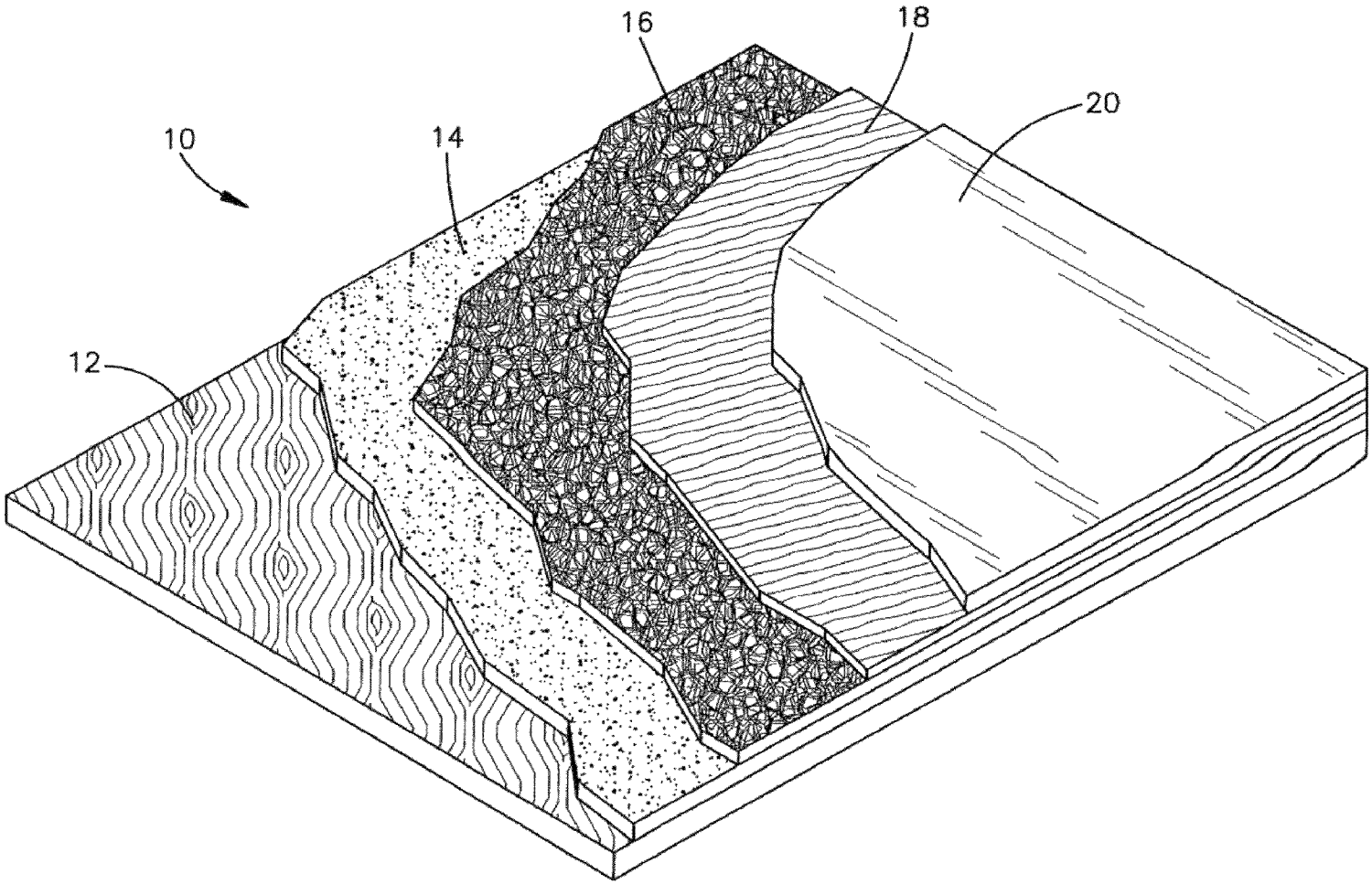
10
12
14
16
18
20

NOISE CONTROL FLOORING SYSTEM

FIELD OF THE INVENTION

The present invention relates to a flooring system and, more particularly, a noise control flooring system that reduces noise transmission in a building structure containing the system.

BACKGROUND OF THE INVENTION

Multi-family housing is a large market for quite living and noise is one of the most litigated issues in apartment and condo construction. Building codes call for specific performance levels for noise and ASTM has separated the noise into airborne and structural causes. For many years, the common method of controlling vibration noise in wood and concrete floor/ceiling assemblies has been to pour a floating substrate on top of a void creating device commonly referred to as an "entangled net". The entangled net is 90% air with more rigid polymer filaments supporting a separation fabric layer that suspended the floating substrate from 0.125" to 1.0" above a wood subsurface creating a void space. The void limited touching of the two solid materials (subfloor and floating substrate) limited the energy transfer. The limited energy transfer consequently limited the ability of the vibration waves to pass through to the ceiling side of the construction. There are a number of products in the market today that have these characteristics and are successful in achieving code compliance. There are also many developers that are keenly interested in higher levels of performance than this system provides.

The ASTM codes have a one number designation that identifies performance over a broad frequency range from 100 Hz to 3150 Hz. Product performance over the range is measured and deviations from the standard established limit the success of the system's performance. It has been proven that a void space creating material like an entangled net significantly enhances performance of the assembly.

The vibration noise passes in two manners. One means is through the actual touching of the floating floor to the filaments and the filament contact with the subfloor (conduction of vibration waves). The second method is through the air pressure build up within the "entangled net" product, "convection". Consequently, thicker entangled net products perform better since the air is allowed to move more freely through the void space and limits air pressure.

Each flooring assembly performs differently for noise, add or subtract a component like wallboard, change a structural element from a 2"×10" joist to an open web, add a resilient channel and the sound performance will change, sometimes dramatically. Assemblies are tested for their ability to control airborne sound and rated with a Sound Transmission Classification (STC) number. The higher the number, the better the job the assembly does of controlling airborne sound. Vibration or structural sound is rated in a similar manner with an ASTM test resulting in an Impact Insulation Classification number. Again, the higher the number, the better. Additionally, every assembly has a frequency at which it resonates. Just like a tuning fork, a floor will amplify a noise at a given frequency. The goal of the assembly is to bring that frequency down to an inaudible level, the lower the better, although humans can't hear much below 50 Hz.

THE PRIOR ART

Prior art patents and publications of interest include the U.S. patent to Keene et al. U.S. Pat. No. 7,096,630 and U.S. patent application Publication to Keene 2006/0230699. Both the patent and publication disclose the use of an "entangled net" in flooring systems. Neither, however, disclose or suggest that the net be combined with a compressible layer for achieving reduction in noise transmission. The disclosures of the aforesaid patent and publication are herein incorporated by reference.

SUMMARY OF THE INVENTION

In accordance with one aspect of the present invention, a noise control flooring system is provided that reduces noise transmission in a building structure containing the system. The system includes a solid substrate layer, such as a layer of concrete or wood or the like. A compressible layer overlies at least a portion of the substrate layer. An entangled net layer overlies at least a portion of the compressible layer with the entangled net layer being comprised of multiple polymers filaments and air, together forming a void space. A separation layer overlies at least a portion of the entangled net layer such that the separation layer serves to carry a floating, solid substrate layer, such as a concrete layer and wherein the concrete layer provides loading for causing the compressible layer to compress into the overlying entangled net layer.

In accordance with a more limited aspect of the present invention, the separation layer is constructed of material that is air and vapor pervious while, at the same time, is substantially liquid impervious.

In accordance with a still further limited aspect of the present invention, the compressible layer compresses into the bottom side of the entangled net layer as a result of the loading from the floating substrate, thereby creating a small cushion under the filaments of the entangled net layer pressing back toward the overlying floating substrate layer.

In accordance with a still further limited aspect of the present invention, the compressible layer is made from a polymer-based filament in a process known as carding.

In accordance with a still further aspect of the present invention, the carding process employed in the compressible layer includes combing the filaments of the compressible layer in one direction, together with needling them and heating them and causing them to be combined in a monolithic mat.

BRIEF DESCRIPTION OF THE DRAWING

The foregoing and other features of the present invention will become more apparent to one skilled in the art to which the present invention relates upon consideration of the following description of the invention with reference to the accompanying drawing, wherein:

The sole FIGURE, FIG. 1, is a perspective view of a flooring system containing the present invention.

DESCRIPTION OF EXAMPLE EMBODIMENT

Referring now the drawing, FIG. 1, there is illustrated flooring system 10 which includes a solid substrate 12. This substrate is illustrated as being a layer of wood, although it may take other forms, such as a layer of concrete. A compressible layer 14, to be discussed in greater detail hereinbelow, overlies at least a portion of the substrate layer 12. An entangled net layer 16, which takes the form of a net layer as illustrated and described in the U.S. Pat. No. 7,096,630. The net layer 16 overlies at least a portion of the compressible layer 14. A separation layer 18 overlies at least a portion of the net layer 16. This separation layer 18 serves to carry a floating, solid substrate layer thereupon. The substrate layer 20 provides loading for causing the compressible layer 14 to compress into the overlying entangled net layer 16.

As more completely described in the aforesaid U.S. Pat. No. 7,096,630, the entangled net layer 16 includes a plurality of intertwined filaments that twist and turn about at random and are bonded at random into sections or contact zones as by heat bonding or other suitable bonding or connection technique. These filaments may be of any suitable strong and mildew-resistant polyethylene-type material, olefin or polymer. These are formed in a desired thickness such as on the order of about ¼" to about ¾" to provide the desired breathability and venting capability for water vapor, air and other gaseous substances.

The separation layer 18 that overlies a portion of the entangled net layer 16 is preferably a material that is air and vapor pervious while, at the same time, is substantially liquid impervious. This layer is also described in detail in U.S. Pat. No. 7,096,630 and is referred to therein as the barrier sheet. As described therein, this layer is preferably a non-woven film-like material. It functions to confine liquids, such as water, to the area atop thereof, such as a hardenable cement-type material may be poured to harden or cure in place. This substrate layer 20, which overlies at least a portion of layer 18, is a floating solid substrate and may take forms such as cement or wood, or the like. Preferably, however, it is a gypsum cement layer.

In the embodiment illustrated in FIG. 1, there is provided a compressible layer 14 that overlies at least a portion of the substrate layer 12 and is located between the substrate layer 12 and the entangled net layer 16.

This compressible layer 14 is manufactured from an ultra lightweight fabric that is "cotton" like in nature. The "cotton" fabric is engineered to compress into the bottom side of the entangled net 16 creating a small cushion under the filaments and pressing back toward the floating substrate 20. The "cotton" fabric 14 is really made from a polymer based filament in a manufacturing process known as carding. In carding, chopped filaments are combed in one direction and then heated and needled to make them combine into a monolithic mat. Needling is the driving and removing of sharp, thin metal (needles) through the filaments to entangle them together. This carding/heating/needling process allows for the material to achieve a designation as a high loft or thick fabric quality With the thick product, a 100 gram per square meter material can be from 0.125" thick to 0.626" thick, depending on density. Many other products that are carded/heated/needled are engineered to be dense and flat. Consequently, this fabric is highly compressible and can be engineered to almost completely compress under a typical load, such as the load of a floating substrate.

In this application, the fabric is between 50 gsm (grams per square meter) and 200 gsm. The floating substrate 20 is typically a gypsum concrete underlayment that is poured onto a separation layer 18 and hardens to a compressive strength of approximately 2000 psi (pounds per square inch). The floating substrate is typically between 0.75" and 2.0" in thickness and overall weighs between 7.5 pounds per square foot and 20 pounds per square foot. Adjusting the fabric density will allow for the proper compression of the high loft fabric; with the goal of achieving a fully loaded compressible fabric that allows the gypsum concrete floating substrate to have a solid base.

Extensive sound tests have been performed on this product and found that it performs between 3 and 5 points (in the ASTM standard for IIC) better than a mat without the high loft fabric. In actual octave band performance, the material greatly limits the dB level from 125 Hz to 2500 Hz to the tune of 4 to 6 dB or a halving of the sound level. The mat with this compressible fabric layer performs better at 0.25" than the typical "entangled net" at 0.75" of thickness, without the compressed fabric.

Three qualities work in an impact noise control mat void space, resilience and thickness. Vibration noise is transmitted via conduction first and through air pressure build up secondly. So, the actual amount of contact between two solid materials works to pass vibration noise easily. If one of the materials is resilient, there is an absorption effect. If the materials have resilience or air space, the thicker the material or void space is, the better the noise absorption will be. The thickness in a resilient, mostly void product works well at controlling vibration noise. Next, different types of materials will absorb different frequencies so, if in the same space; the material changes from 95% air to 50% air and the resilience changes too, different frequencies will be absorbed adding to the noise control. The compressible fabric in conjunction with the "entangled net" product does a number of things. First, it is more resilient than the entangled net, second, it is a different density than the entangled net and lastly, it limits air pressure build up by "diffusing" air movement.

The compressible fabric adds so little to the thickness in the application and controls noise in the floor so well. It almost completely compresses to the original thickness of the entangled net mat (0.25" is one version but the entangled net could be up to an inch in thickness and as small as 0.10"). The profile added is about 0.05" and the stability/flex of the material is very good because the dense; entangled net material limits the deflection. Any product that was highly compressible like a fabric or foam would work in this case. Any product that had a void space such as dimpled sheets of plastic or has a dimpled bottom might have similar success with a highly compressible fabric.

Air movement is the important element. The overall thickness of the composite changes very little. The composite in this case is adding a fabric that, when left uncompressed, is of relative substantial thickness but when fully compressed, adds only about five one hundredths of an inch to the assembly. In fact, the fabric in many areas is as thick as the uncompressed fabric but has filled in the void area in the entangled net. The pressure built up in the entangled net is diffused by the highly compressed fabrics division of the air space. In this case, the composite almost completely compresses into the void space. Preferably, the composition is of a thickness equal to 0.25". All of the products used must support the concrete substrate and finished floor overlying the structure so there is a balance between sponginess or resilience for noise control and stiffness for structural support. The filaments of the entangled net act as support points in the composite and limit deflection.

It will be understood that the above description of the present invention is susceptible to various modifications, changes and adaptations, and the same are intended to be comprehended within the meaning and range of equivalents of the appended claims. The presently disclosed embodiment is considered in all respects to be illustrative, and not restrictive. The scope of the invention is indicated by the appended claims, rather than the foregoing description.

Having described the invention, the following is claimed:

1. A noise control flooring system that reduces noise transmission in a building structure containing the system and which comprises:

a solid substrate layer;

a compressible layer overlying at least a portion of said substrate layer, the compressible layer comprising a high-loft nonwoven fabric, wherein the weight of the fabric is between 50 gsm and 200 gsm, and the fabric is compressible from an initial thickness of between 0.125 in (0.318 cm) and 0.626 in (1.590 cm) to a compressed thickness of about 0.05 in (0.125 cm);

a void space creating device overlying at least a portion of said compressible layer; and a separation layer that overlies at least a portion of said void space creating device and which separation layer serves to carry a floating solid substrate layer thereupon and which provides loading for causing said compressible layer to compress into said overlying device, wherein the compressible layer at least partially fills a void space of the overlying void space creating device.

2. A system as set forth in claim 1 wherein said void space creating device is an entangled net layer comprised of multiple polymer filaments and air together forming the void space.

3. A system as set forth in claim 2 wherein said separation layer is constructed of material that is air and vapor pervious while, at the same time being substantially liquid impervious.

4. A system as set forth in claim 2 wherein said compressible layer is compressed by the bottom side of said entangled net layer as a result of loading from said floating substrate thereby creating a small cushion under the filaments of said entangled net layer pressing back toward the overlying floating substrate layer.

5. A system as set forth in claim 2 wherein said compressible layer is made from polymer-based filaments in a process known as carding.

6. A system as set forth in claim 5 wherein said carding process includes combing said filaments in one direction.

7. A system as set forth in claim 6 wherein said filaments of said compressible layer are needled and heated causing them to be combined into a monolithic mat.

8. A system as set forth in claim 7 wherein said needling is the driving and removing of sharp needle-like elements through the filaments to entangle them together and allowing material to achieve a high loft or thick fabric quality.

9. A system as set forth in claim 8 wherein said floating substrate layer is a gypsum concrete layer.

10. A system as set forth in claim 2 wherein said polymer filaments of said entangled net layer comprise a plurality of intertwined polymer filaments that twist and turn about at random and are bonded at random into sections or contact zones as by heat bonding or other suitable bonding or connection technique.

11. A noise control flooring system that reduces noise transmission in a building structure containing the system and which comprises:

a solid substrate layer;

a compressible layer overlying at least a portion of said substrate layer, the compressible layer comprising a high-loft nonwoven fabric, wherein the weight of the fabric is between 50 gsm and 200 gsm, and the fabric is compressible from an initial thickness of between 0.125 in (0.318 cm) and 0.626 in (1.590 cm) to a compressed thickness of about 0.05 in (0.125 cm);

an entangled net layer overlying at least a portion of said compressible layer wherein said net layer is comprised of multiple polymer filaments and air together forming a void space; and a separation layer constructed of material that is air and vapor pervious while, at the same time, being substantially liquid impervious, said separation layer overlying at least a portion of said entangled net layer and which separation layer serves to carry a floating solid substrate layer thereupon and which provides loading for causing said compressible layer to compress into said overlying entangled net layer, wherein the compressible layer at least partially fills the void space of the overlying entangled net layer.

12. A system as set forth in claim 11 wherein said compressible layer comprises a plurality of polymer filaments and is formed using a carding process that includes combing said plurality of polymer filaments in one direction.

13. A system as set forth in claim 12 wherein said plurality of polymer filaments of said compressible layer are needled and heated causing them to be combined into a monolithic mat.

14. A system as set forth in claim 13 wherein said needling is the driving and removing of sharp needle-like elements through the filaments to entangle them together and allowing the entangled filaments to achieve a high loft or thick fabric quality.

15. A system as set forth in claim 14 wherein said floating substrate layer is a gypsum concrete layer.

* * * * *